US009986862B2

(12) United States Patent
Hyman

(10) Patent No.: US 9,986,862 B2
(45) Date of Patent: Jun. 5, 2018

(54) SINGLE-HANDED FOOD TRAY WITH ADVERTISING PANEL

(71) Applicant: Eric Michael Hyman, Spokane, WA (US)

(72) Inventor: Eric Michael Hyman, Spokane, WA (US)

( * ) Notice: Subject to any disclaimer, the term of this patent is extended or adjusted under 35 U.S.C. 154(b) by 0 days. days.

(21) Appl. No.: 15/001,428

(22) Filed: Jan. 20, 2016

(65) Prior Publication Data

US 2017/0202384 A1 Jul. 20, 2017

(51) Int. Cl.

| | |
|---|---|
| ***A47G 23/06*** | (2006.01) |
| ***B65D 1/36*** | (2006.01) |
| *A47G 21/00* | (2006.01) |

(52) U.S. Cl.

CPC ..... *A47G 23/0608* (2013.01); *A47G 23/065* (2013.01); *A47G 23/0625* (2013.01); *B65D 1/36* (2013.01); *A47G 21/001* (2013.01); *A47G 2400/06* (2013.01)

(58) Field of Classification Search

CPC ..... A47G 21/001; A47G 23/0608; A47G 23/0625; A47G 23/065; A47G 2400/06; B65D 1/36

USPC ..... 220/23.8; D7/553.1, 553.2, 553.3, 553.4, D7/553.5, 553.6, 553.7, 553.8

See application file for complete search history.

(56) References Cited

U.S. PATENT DOCUMENTS

| | | | | | |
|---|---|---|---|---|---|
| 876,808 | A | * | 1/1908 | Kinert | A47G 19/02 220/23.8 |
| D54,971 | S | * | 4/1920 | Thompson | 220/23.8 |
| 1,595,356 | A | * | 8/1926 | Moseman | A47G 19/02 220/23.8 |
| 3,122,265 | A | * | 2/1964 | Innis | A47G 23/06 206/502 |
| 3,295,737 | A | * | 1/1967 | Page | A47G 23/06 206/564 |
| 3,532,247 | A | * | 10/1970 | Bridges | B65D 81/3834 206/217 |
| 3,850,333 | A | * | 11/1974 | Reichert | B65D 1/36 206/545 |
| D255,081 | S | * | 5/1980 | Ramorini | D11/156 |
| D255,310 | S | * | 6/1980 | Spencer | D7/553.5 |
| 4,219,144 | A | * | 8/1980 | Hagelberg | A47G 19/065 206/563 |
| 4,291,805 | A | * | 9/1981 | Seeley | A47G 23/065 206/518 |
| D270,225 | S | * | 8/1983 | Chiulli | D7/357 |
| D280,669 | S | * | 9/1985 | Hammeke | D3/308 |
| D296,404 | S | * | 6/1988 | Lowenbein | A47G 19/065 D7/553.1 |
| D320,909 | S | * | 10/1991 | Szablak | D30/133 |
| 5,152,398 | A | * | 10/1992 | Forestal | A47G 19/065 206/561 |
| 5,167,973 | A | * | 12/1992 | Snyder | B65D 1/36 206/222 |

(Continued)

*Primary Examiner* — Joshua E Rodden

(74) *Attorney, Agent, or Firm* — Cermak Nakajima & McGowan LLP; Adam J. Cermak

(57) ABSTRACT

Trays are designed to allow an individual to carry their food on a tray where the individual has complete control of the tray with one hand. The tray can be customized for a particular food vendor's menu. At the same time, the tray allows for advertising information on the front view. The tray is constructed for a one time use and therefore is made from a thin plastic or cardboard.

4 Claims, 15 Drawing Sheets

(56) References Cited

U.S. PATENT DOCUMENTS 5,323,910 A * 6/1994 van de Graaf, Jr. . A47G 19/065 206/557
5,598,944 A * 2/1997 Aragona ..... A47G 19/06 206/518
5,607,077 A * 3/1997 Torkelson ..... A47G 19/065 206/217
5,887,749 A * 3/1999 Schommer ..... A01K 5/0114 206/564
5,922,376 A * 7/1999 Privert ..... B65D 1/36 206/461
5,947,011 A * 9/1999 Xu ..... A47G 19/065 206/557
6,036,020 A * 3/2000 Distler ..... A47G 23/06 206/217
6,129,235 A * 10/2000 Creske ..... A47G 19/065 206/549
6,264,026 B1 * 7/2001 Bradley ..... A47G 19/065 206/217
D482,963 S * 12/2003 Vincent ..... D9/761
6,883,692 B2 * 4/2005 Harden ..... B60N 3/002 206/563
7,000,799 B1 * 2/2006 Hamre ..... A47G 19/065 220/23.8
7,798,354 B2 * 9/2010 Stowers, Sr. ..... A47G 19/065 206/562
7,874,449 B1 * 1/2011 Studee ..... A47G 19/02 206/219
D728,978 S * 5/2015 Williams ..... D6/675
9,113,735 B1 * 8/2015 Jansma ..... A47G 23/0208
D744,860 S * 12/2015 Walker ..... D9/761
D785,406 S * 5/2017 Wansink ..... D7/553.2
D793,812 S * 8/2017 Dennis ..... D7/553.2
2004/0238537 A1 * 12/2004 Ojeda ..... B60N 2/4686 220/23.8
2005/0045629 A1 * 3/2005 Conarro ..... A47G 19/06 220/23.8
2005/0082287 A1 * 4/2005 Shendelman ..... A47G 19/065 220/23.8
2006/0049194 A1 * 3/2006 Kuhn ..... A47G 19/065 220/23.8
2006/0266748 A1 * 11/2006 Crawford ..... A47G 19/065 220/23.8
2008/0142515 A1 * 6/2008 Phifer ..... A47G 19/06 220/23.8
2017/0079451 A1 * 3/2017 Wansink ..... A47G 19/025

* cited by examiner

SINGLE-HANDED FOOD TRAY WITH ADVERTISING PANEL

BACKGROUND

Field of Endeavor

This disclosure relates to trays for holding food items.

Brief Description of the Related Art

Food trays often fail to insure that the food does not fall off the tray due to a bump by another person in a crowd type of atmosphere prevalent in arena type environments, nor are they used as an advertisement billboard of sorts to advertise a sports team, a food product, or a food vendor. Additional revenue opportunities are thus lost for the provider of the tray at their food booth.

SUMMARY

Aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

The "Go Tray", as trays described herein are named, is literally a tray to be used by an individual to carry their food when they are on the go anywhere. The anywhere is a sporting event, a county fair, an amusement park, an airport, a movie theatre, and any stand-alone food booth. What makes the "Go Tray" so unique is that its design allows for it to be carried and totally balanced with one hand. This is so critical for the venues mentioned above as it allows for complete use of the other hand to either eat while standing or walking or to be pulling a piece of luggage in an airport terminal. Its design also allows for the "Go Tray", because of its perfect balance, to be placed on a table or an individual's lap once they have arrived at a more permanent seat. At the same time, it has the ability to be picked up in an arena venue when you need to stand to let someone pass by to get to a seat further down a row or to stand up and cheer for your favorite team.

Because of its construction, utilizing plastic, cardboard, or any similar type material in order to meet vendor requirements, it is capable of carrying all food products and will be customized for each individual vendor's fair. The shape of the "Go Tray" will change based upon specific requirements of a particular vendor. Items that can be carried in their own individual pockets are: hamburgers, hot dogs, corn dogs, sandwiches, French fries, pizza, Teriyaki bowls, potato chips, soda/drinks, popcorn, napkins, plastic ware, and condiments. The individual pockets allow for items to be carried without falling off the Tray while at the same time allowing for the individual's hand to be able to easily pick-up the item. The "Go Tray" can be manufactured to accommodate either hand. The size of the pockets also allows for condiments to be placed on the burger, hot dog, or sandwich easily so as to accommodate those venues that have a condiment table outside of the vendor food booth.

The "Go Tray" is also unique in that the food shield, which is located on the front of the "Go Tray, is designed to assist in insuring that the food does not fall off the tray due to a bump by another person in a crowd type of atmosphere prevalent in arena type environments, can also be used as an advertisement billboard of sorts to advertise a sports team, a food product, or a food vendor. This allows for additional revenue opportunities for the provider of the "Go Tray" at their food booth.

SPECIFICATIONS OF THE "GO TRAY"

FIG. 1A Top View

Measurements are approximately 8½" in width and 13½" in length. The large rectangular pocket, 5" in width and 6" in length, is designed to hold a sandwich or hamburger and the smaller rectangular pocket, 2¼"×5", is designed to hold potato chips or French fries. The large circular pocket, which is 3" in circumference, is designed to hold a beverage. The smaller circular pockets, which are 1½" in circumference, were designed to hold plastic ware, napkins, and condiments.

Figure 1A:
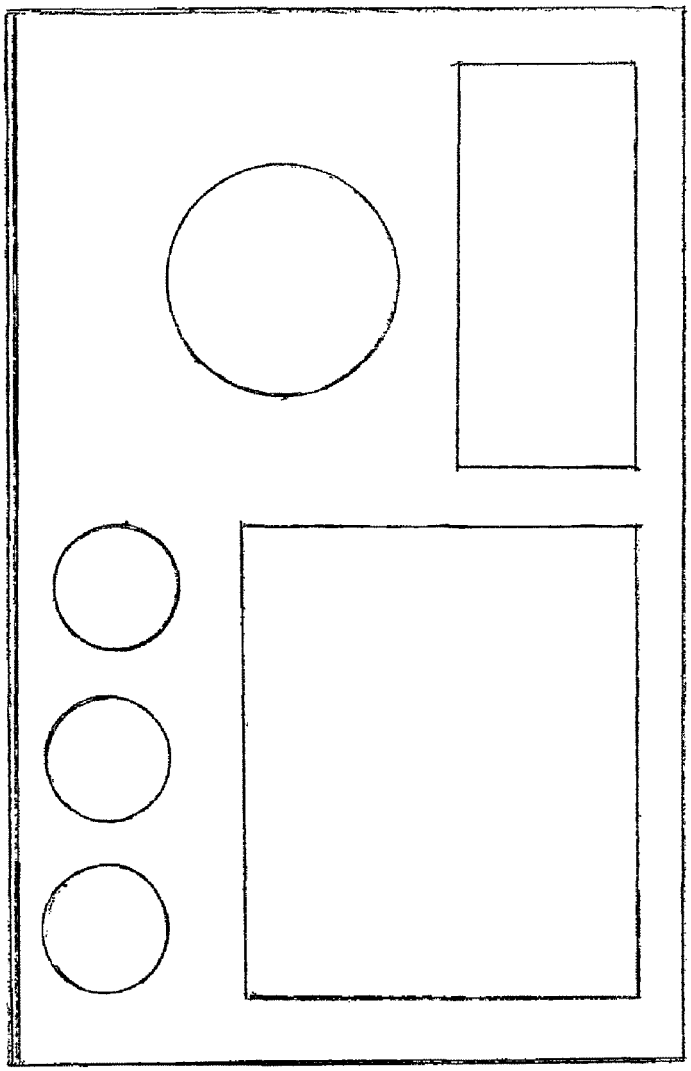
FIG. 1A illustrates a top plan view of a first exemplary embodiment.
Figure 1B:
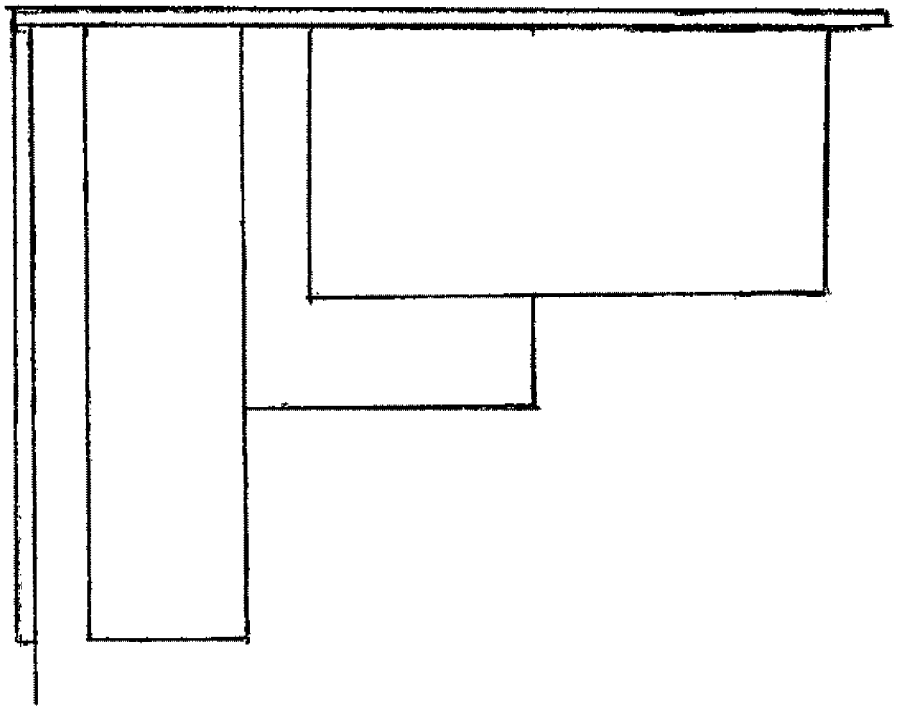
FIG. 1B illustrates a right side elevational view of the embodiment of FIG. 1A.
Figure 1C:
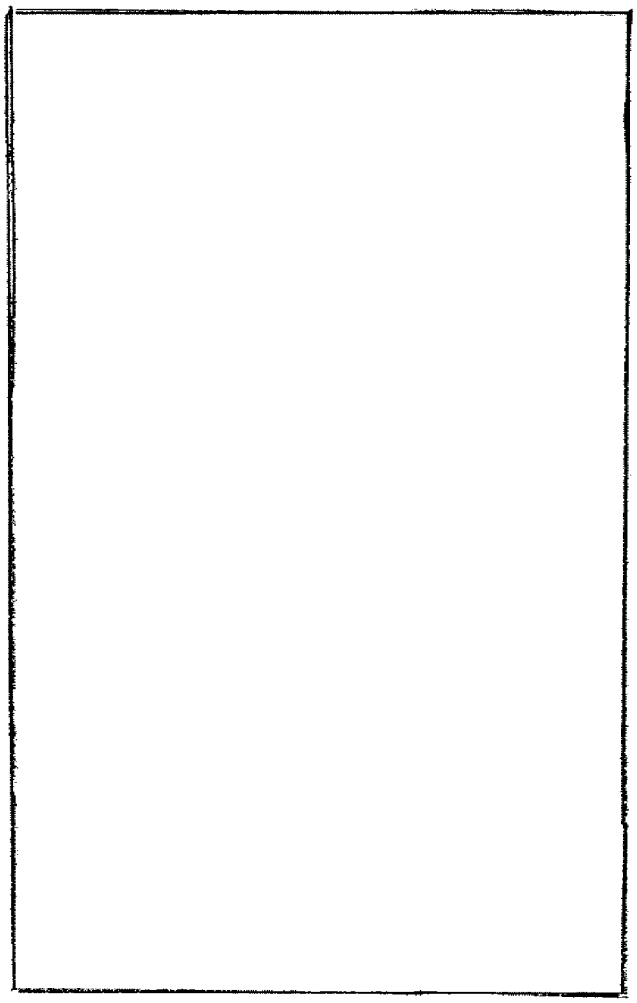
FIG. 1C illustrates a front side elevational view of the embodiment of FIG. 1A.

FIG. 1B Right Side View

Measurement are approximately 5" in height and a width of 8½". Shows the depth of the pockets explained in the Top View above. The large rectangular pocket designed to hold a sandwich or hamburger is approximately 2" deep. The smaller rectangular pocket designed to hold potato chips or French fries is also 2" deep. The large circular pocket, designed to hold a beverage, is 3" deep and the small circular pockets designed to hold plastic ware, napkins, and condiments is 5" deep.

FIG. 1C Front View

Measurements are approximately 5½" in height and a width of 13½". The front is designed to assist in insuring that the food does not fall off the tray due to a bump by another person in a crowd type of atmosphere prevalent in arena type environments and can also be used as an advertisement billboard of sorts to advertise a sports team, a food product, or a food vendor.

Figure 1D:
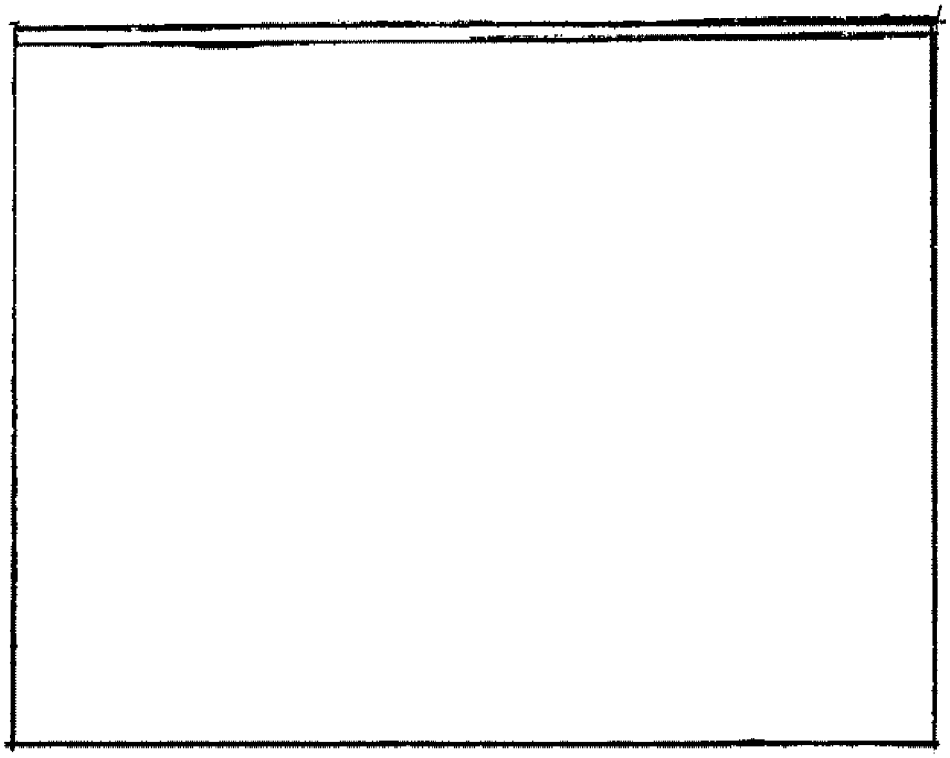
FIG. 1D illustrates a left side elevational view of the embodiment of FIG. 1A.
Figure 1E:
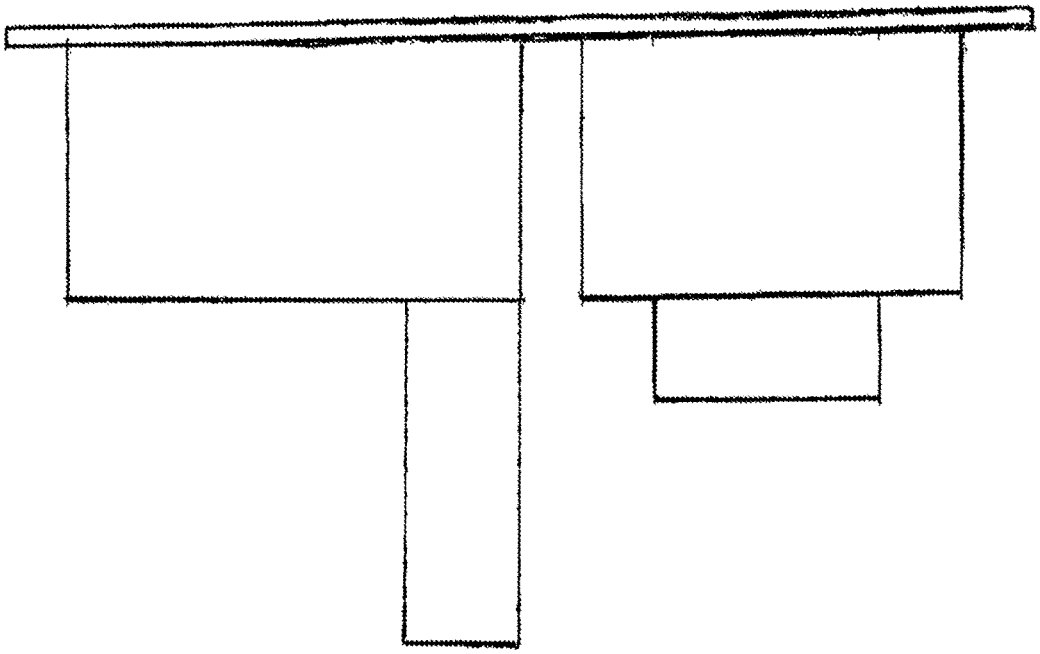
FIG. 1E illustrates a rear side elevational view of the embodiment of FIG. 1A.

FIG. 1D Left Side View

Measurements are approximately 5" in height and a width of 8½". This side was designed to help balance the tray when a person is sitting down, on their lap or at a table.

FIG. 1E Back View

Measurements are approximately 5" in height and a width of 13½". The back view is open allow for the individual's hand to comfortably gain access to the sides of the beverage pocket which is the holder so that the individual can carry the tray.

FIG. 2A Top View

Measurements are approximately 8½" in width and 13½" in length. The large pie shaped pocket, 6½" in length at the longest part and 6" in width, is designed to hold a piece of Pizza. The smaller rectangular pocket, 5" long and 2¼" wide, is designed to hold potato chips or French fries. The large circular pocket, which is 3" in circumference, is designed to hold a beverage. The smaller circular pockets, which are 1½" in circumference, were designed to hold plastic ware, napkins, and condiments.

Figure 2A:
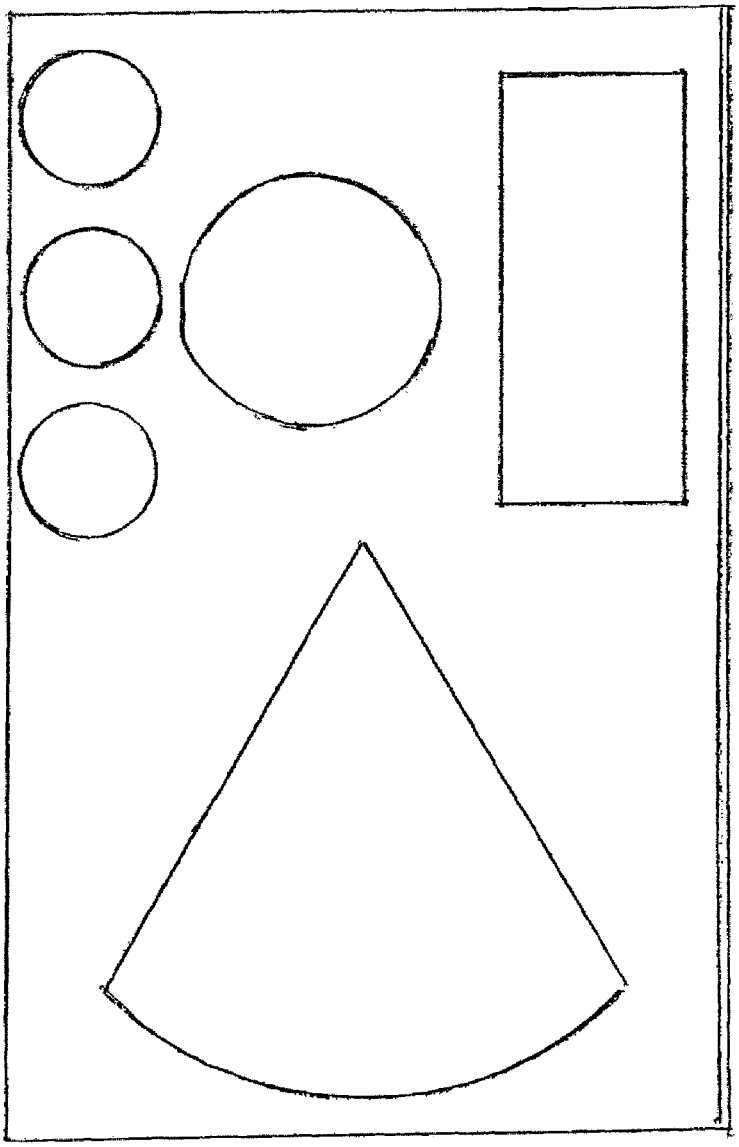
FIG. 2A illustrates a top plan view of a second exemplary embodiment.
Figure 2B:
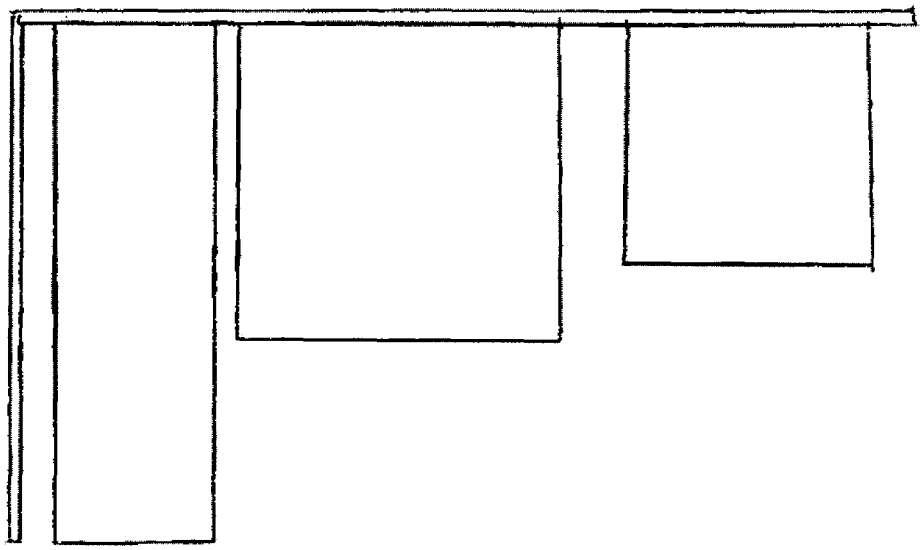
FIG. 2B illustrates a right side elevational view of the embodiment of FIG. 2A.
Figure 2C:
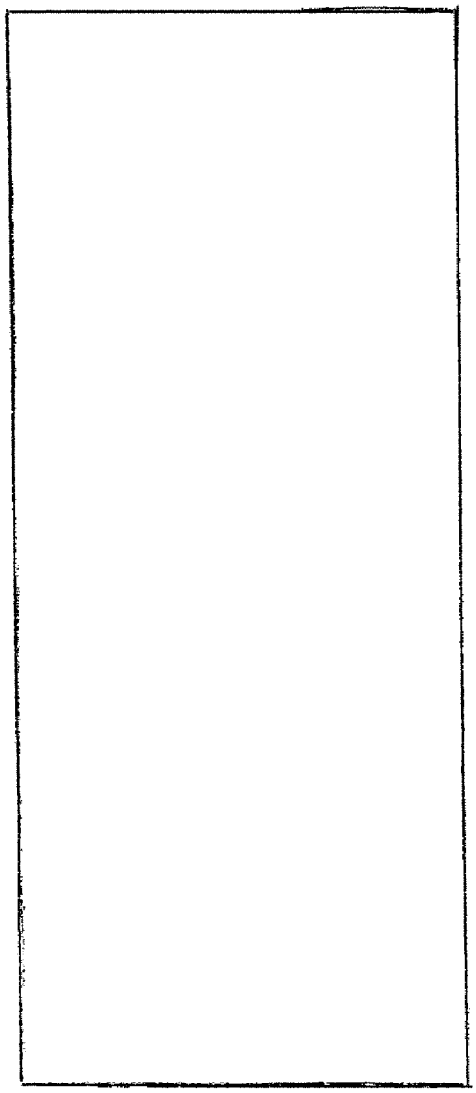
FIG. 2C illustrates a front side elevational view of the embodiment of FIG. 2A.

FIG. 2B Right Side View

Measurement are approximately 5" in height and a width of 8½". Shows the depth of the pockets explained in the Top View above. The large pie shaped pocket designed to hold a piece of Pizza is approximately 2" deep. The rectangular pocket designed to hold potato chips or French fries is also 2" deep. The large circular pocket, designed to hold a beverage, is 3" deep and the small circular pockets, designed to hold plastic ware, napkins, and condiments are 5" deep.

FIG. 2C Front View

Measurements are approximately 5½" in height and a width of 13½". The front is designed to assist in insuring that the food does not fall off the tray due to a bump by another person in a crowd type of atmosphere prevalent in arena type environments and can also be used as an advertisement billboard of sorts to advertise a sports team, a food product, or a food vendor.

Figure 2D:
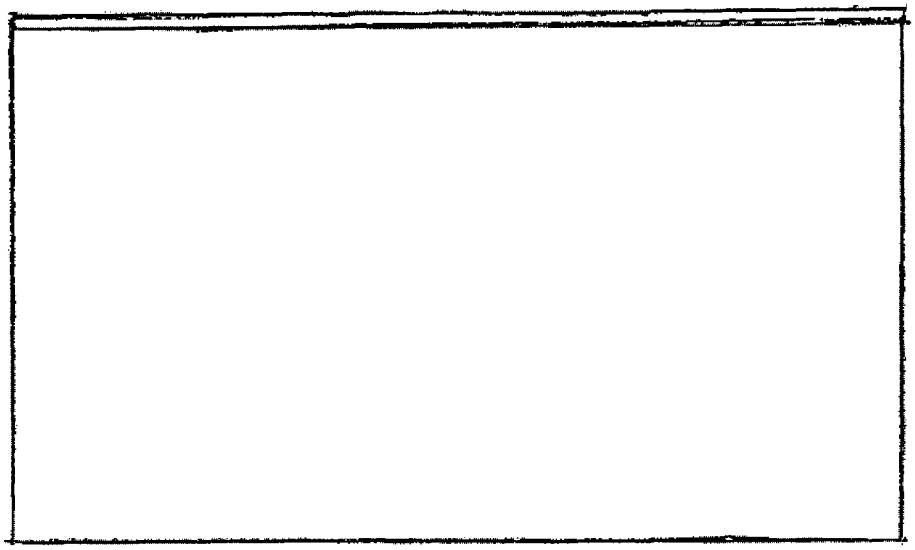
FIG. 2D illustrates a left side elevational view of the embodiment of FIG. 2A.
Figure 2E:
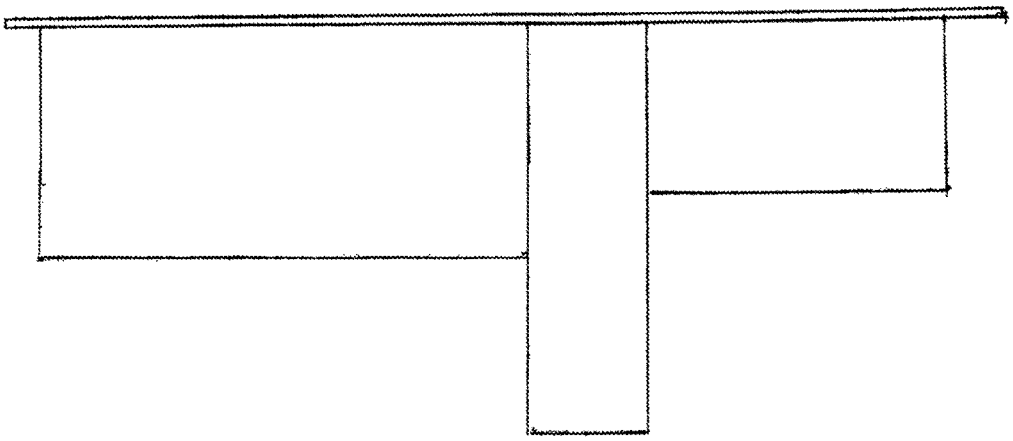
FIG. 2E illustrates a rear side elevational view of the embodiment of FIG. 2A.

FIG. 2D Left Side View

Measurements are approximately 5" in height and a width of 8½". This side was designed to help balance the tray when a person is sitting down, on their lap or at a table.

FIG. 2E Back View

Measurements are approximately 5" in height and a width of 13½". The back view is open allow for the individual's hand to comfortably gain access to the sides of the beverage pocket which is the holder so that the individual can carry the tray.

FIG. 3A Top View

Measurements are approximately 8½" in width and 13½" in length. The large circular pocket, which measures 7¼" in circumference, is designed to hold a rice bowl or bowl of soup. The rectangular pocket, 2¼"×4"; is designed to hold crackers or sauces. The large circular pocket, which is 3" in circumference, is designed to hold a beverage. The smaller circular pockets, which are 1½" in circumference, were designed to hold plastic ware, napkins, and condiments.

Figure 3A:
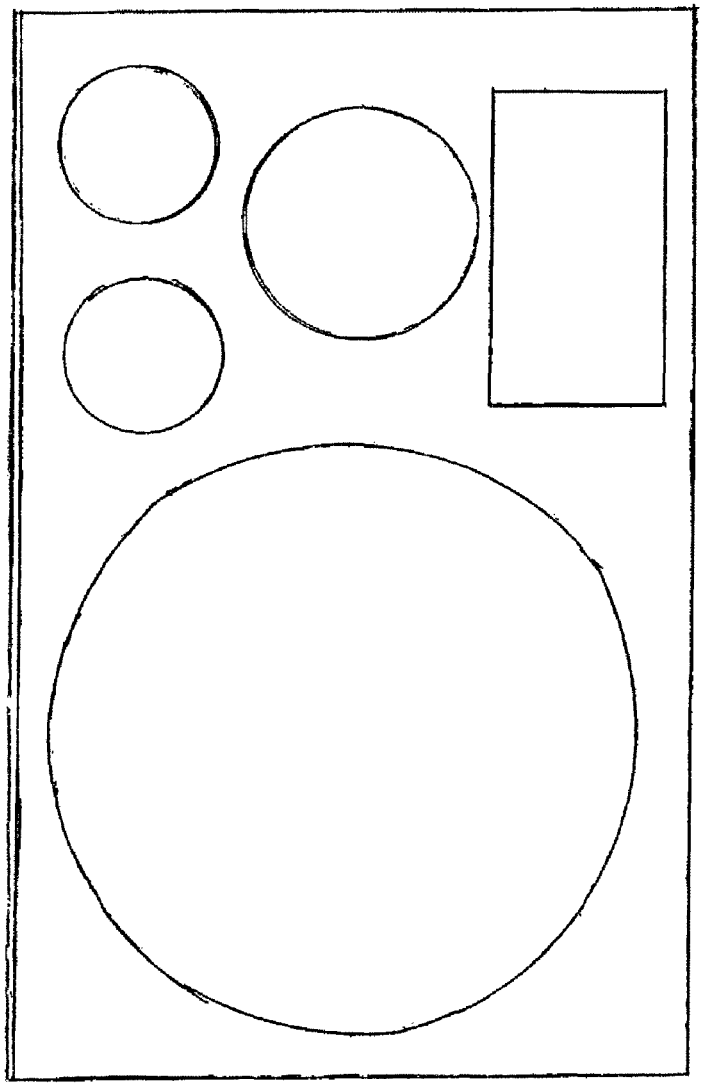
FIG. 3A illustrates a top plan view of a third exemplary embodiment.
Figure 3B:
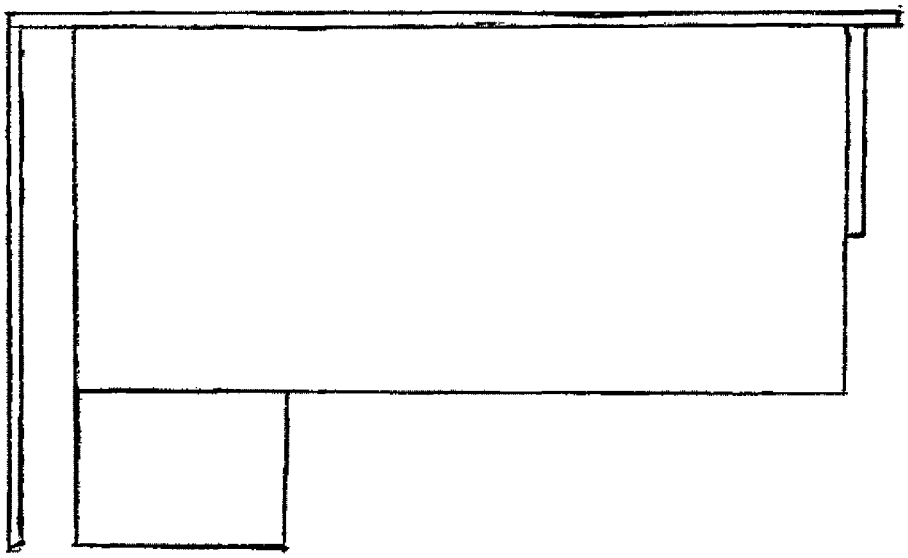
FIG. 3B illustrates a right side elevational view of the embodiment of FIG. 3A.
Figure 3C:
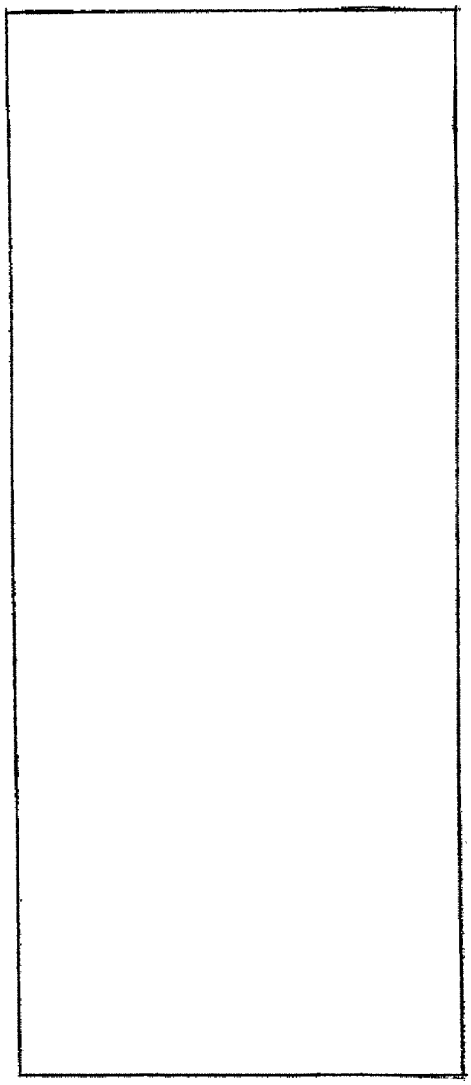
FIG. 3C illustrates a front side elevational view of the embodiment of FIG. 3A.

FIG. 3B Right Side View

Measurements are approximately 8½" in width and 13½" in length. The large circular pocket, which measure 7¼" circumference is 3½" deep, is designed to hold a rice bowl or bowl of soup. The rectangular pocket, 2¼"×5", is hidden from view, designed to hold crackers or sauces, is only 2' deep. The large circular pocket, which is 3" in circumference, which is designed to hold a beverage, is also hidden from view as it is 3" deep. The smaller circular pockets, which are 1½" in circumference, which were designed to hold plastic ware, napkins, and condiments, are 5" deep.

FIG. 3C Front View

Measurements are approximately 5½" in height and a width of 13½". The front is designed to assist in insuring that the food does not fall off the tray due to a bump by another person in a crowd type of atmosphere prevalent in arena type environments and can also be used as an advertisement billboard of sorts to advertise a sports team, a food product, or a food vendor.

Figure 3D:
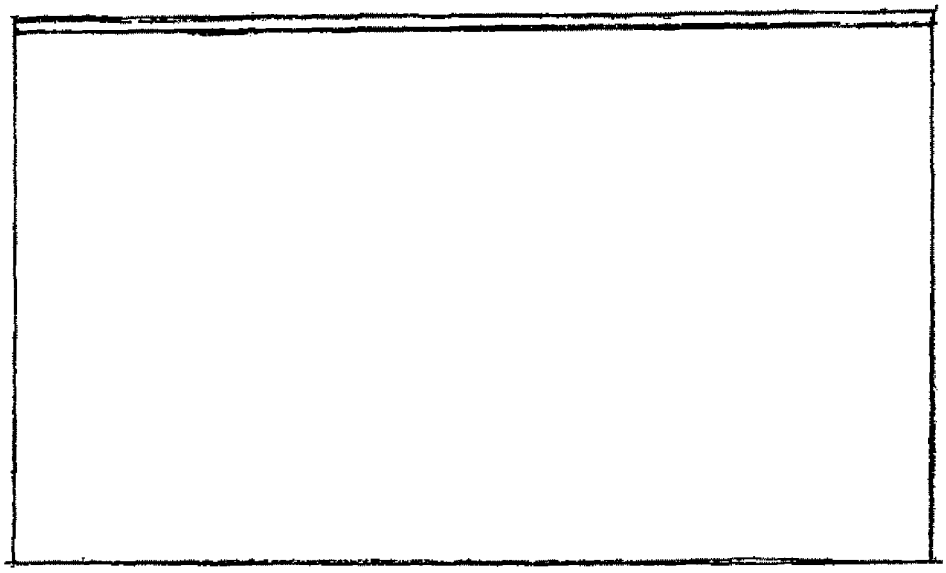
FIG. 3D illustrates a left side elevational view of the embodiment of FIG. 3A.
Figure 3E:
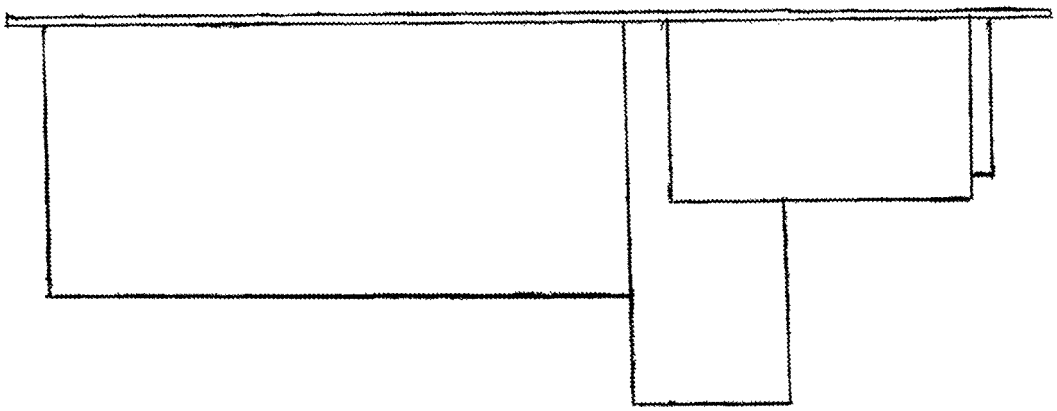
FIG. 3E illustrates a rear side elevational view of the embodiment of FIG. 3A.

FIG. 3D Left Side View

Measurements are approximately 5" in height and a width of 8½". This side was designed to help balance the tray when a person is sitting down, on their lap or at a table.

FIG. 3F Back View

Measurements are approximately 5" in height and a width of 13½". The back view is open allow for the individual's hand to comfortably gain access to the sides of the beverage pocket which is the holder so that the individual can carry the tray.

The invention claimed is:

1. A food tray comprising:

a tray body including a flat upper surface, an outer edge, and a flat panel extending downwardly from said outer edge;

a plurality of pockets formed in the tray body, each pocket including an opening in the tray upper surface, a closed bottom opposite the opening, and a sidewall extending downwardly between the opening and the bottom, at least one of the plurality of pockets having a cylindrical sidewall; and wherein a downward length of the flat panel is the same as a downward length of the at least one pocket having a cylindrical sidewall;

wherein the flat upper surface is rectangular and has four sides, wherein the flat panel extends downwardly from the outer edge along one of the sides, with the remaining three sides forming a free end with no part of the flat panel extending downwardly therefrom.

2. A food tray according to claim 1, wherein the opening of each of the plurality of pockets has a shape selected from the group consisting of square, circular, rectangular, and circular-sector.

3. A food tray according to claim 1, wherein:

each of the plurality of pockets has a downward length; and the downward length of the at least one pocket having a cylindrical sidewall is larger than a downward length of any other of the plurality of pockets.

4. A food tray according to claim 1, wherein said cylindrical sidewall has an outer surface which is entirely cylindrical and uninterrupted between said opening and said bottom, so that a user of the tray can fully encircle said outer surface with their hand.

* * * * *